US008096008B1

(12) United States Patent
Phillips

(10) Patent No.: US 8,096,008 B1
(45) Date of Patent: Jan. 17, 2012

(54) DISPOSABLE CUSHIONING SYSTEMS

(76) Inventor: Ricky R. Phillips, Yuma, AZ (US)

( * ) Notice: Subject to any disclaimer, the term of this patent is extended or adjusted under 35 U.S.C. 154(b) by 167 days.

(21) Appl. No.: 12/510,219

(22) Filed: Jul. 27, 2009

Related U.S. Application Data

(60) Provisional application No. 61/084,537, filed on Jul. 29, 2008.

(51) Int. Cl.
*A47B 1/00* (2006.01)

(52) U.S. Cl. ..... 5/626; 5/625; 128/870

(58) Field of Classification Search ..... 5/620, 625, 5/627, 630, 632, 633, 635, 110–112, 114, 5/417, 419, 420, 722, 730, 655.9; 108/157.1, 108/157.12, 157.14; 297/219.1, 224, 229; 128/870
See application file for complete search history.

(56) References Cited

U.S. PATENT DOCUMENTS

| | | | | |
|---|---|---|---|---|
| 3,336,610 | A * | 8/1967 | Geddings | 5/420 |
| 4,168,554 | A | 9/1979 | Hindes | |
| 4,275,473 | A * | 6/1981 | Poirier | 441/128 |
| 4,879,776 | A * | 11/1989 | Farley | 5/430 |
| 5,056,533 | A * | 10/1991 | Solano | 5/627 |
| 5,129,705 | A * | 7/1992 | Wray | 297/397 |
| 5,819,746 | A | 10/1998 | Walton | |
| 6,067,678 | A | 5/2000 | Trevino | |
| 6,425,399 | B1 | 7/2002 | Hoster, Jr. | |
| 6,848,134 | B1 | 2/2005 | Schenk | |
| 7,028,357 | B2 * | 4/2006 | Holland | 5/626 |
| 7,100,226 | B1 | 9/2006 | Walton | |
| 2005/0000522 | A1 * | 1/2005 | Barnes et al. | 128/870 |
| 2005/0193491 | A1 * | 9/2005 | Zucker et al. | 5/603 |

FOREIGN PATENT DOCUMENTS

WO WO86/07253 12/1986

* cited by examiner

*Primary Examiner* — Robert G Santos
*Assistant Examiner* — Nicholas Polito
(74) *Attorney, Agent, or Firm* — Stoneman Law Patent Group; Martin L. Stoneman; Eric Fish

(57) ABSTRACT

A system for disposable, easily stored, single use, foldable backboard cushions for placement under a patient being transported by a medical backboard. The backboard cushions comprise an adhesive strip to removably adhere the cushion to a medical backboard during use. The cushions comprise living hinges to facilitate folding into a compact unit and unfolding for use. The system also provides a method whereby a choice of permeable or non-permeable cushions may be selected for use.

21 Claims, 5 Drawing Sheets

DISPOSABLE CUSHIONING SYSTEMS

CROSS-REFERENCE TO RELATED APPLICATION

The present application is related to and claims priority from prior provisional application Ser. No. 61/084,537, filed Jul. 29, 2008, entitled "DISPOSABLE CUSHIONING SYSTEMS", the contents of which is incorporated herein by this reference and is not admitted to be prior art with respect to the present invention by the mention in this cross-reference section.

BACKGROUND

This invention relates to providing improved cushioning systems relating to medical backboards (also referred to in the art as spine boards). More particularly, this invention relates to providing a system for disposable, easily stored, medical backboard cushions that are placed under a patient being transported by a medical backboard.

OBJECTS AND FEATURES OF THE INVENTION

A primary object and feature of the present invention is to provide a system for providing such medical backboard cushions.

It is a further object and feature of the present invention to provide such a system providing compact storage for a backboard cushion.

It is a further object feature of the present invention to provide such a system with a foldable backboard cushion.

It is a further object feature of the present invention to provide such a system wherein the cushion is disposable after a single use.

It is a further object feature of the present invention to provide such a system wherein the cushion is adhesively applied to a backboard utilizing a removable adhesive.

A further primary object and feature of the present invention is to provide such a system that is efficient, inexpensive, and handy. Other objects and features of this invention will become apparent with reference to the following descriptions.

SUMMARY OF THE INVENTION

In accordance with a preferred embodiment hereof, this invention provides a single-use disposable cushion system, relating to cushioning at least one medical backboard having at least one patient holding surface, comprising: at least one cushion structured and arranged to cushion the at least one medical backboard; wherein such at least one cushion is structured and arranged to essentially cover the at least one patient holding surface; wherein such at least one cushion comprises at least one folding element structured and arranged to assist folding such at least one cushion; wherein such at least one folding element comprises at least one transverse folding element to assist folding such at least one cushion longitudinally so as to decrease at least one longitudinal length; wherein such at least one transverse folding element comprises at least one cut-away portion; and wherein such at least one cushion comprises at least one attacher structured and arranged to assist removable attachment of such at least one cushion to the at least one medical backboard.

Moreover, it provides such a single-use disposable cushion system wherein such at least one cut-away portion comprises at least one living hinge. Additionally, it provides such a single-use disposable cushion system wherein such at least one cushion is structured and arranged to be pre-packaged in at least one sanitary container. Also, it provides such a single-use disposable cushion system wherein such at least one cushion comprises dimensions of: about 68 inches to about 72 inches long, about 12 inches to about 14 inches wide, and about 1 inch to about 3 inches in thickness. In addition, it provides such a single-use disposable cushion system wherein such at least one cushion comprises absorbent material. And, it provides such a single-use disposable cushion system wherein such absorbent material comprises expanded polyurethane having at least about a 1.4 pound density.

Further, it provides such a single-use disposable cushion system wherein such at least one cushion comprises non-absorbent material. Even further, it provides such a single-use disposable cushion system wherein such non-absorbent material comprises micro cellular closed cell crosslink polyethylene having at least about a 2 pound density. Moreover, it provides such a single-use disposable cushion system wherein such at least one living hinge element comprises at least one V-cut groove in such at least one cushion. Additionally, it provides such a single-use disposable cushion system wherein such at least one cushion comprises exactly two cut-away portions. Also, it provides such a single-use disposable cushion system wherein such at least one transverse folding element comprises exactly two living hinge elements. In addition, it provides such a single-use disposable cushion system wherein such at least one attacher comprises adhesive. And, it provides such a single-use disposable cushion system wherein such at least one adhesive comprises releasable adhesive.

Further, it provides such a single-use disposable cushion system further comprising at least one headrest. Even further, it provides such a single-use disposable cushion system wherein such at least one headrest is removably attachable to such at least one cushion. Moreover, it provides such a single-use disposable cushion system wherein such at least one headrest comprises essentially the same material as such at least one cushion. Additionally, it provides such a single-use disposable cushion system further comprising at least one medical backboard.

In accordance with another preferred embodiment hereof, this invention provides a single-use disposable cushion system, relating to cushioning at least one medical backboard having at least one patient holding surface, comprising: at least one cushion structured and arranged to cushion the at least one medical backboard; wherein such at least one cushion is structured and arranged to essentially cover the at least one patient holding surface; wherein such at least one cushion comprises at least one folding element structured and arranged to assist folding such at least one cushion; wherein such at least one folding element comprises at least one transverse folding element to assist folding such at least one cushion longitudinally so as to decrease at least one longitudinal length; wherein such at least one transverse folding element comprises at least one cut-away portion; wherein such at least one cut-away portion comprises at least two living hinges; wherein such at least one cushion comprises at least one attacher structured and arranged to assist removable attachment of such at least one cushion to the at least one medical backboard; wherein such at least one cushion is structured and arranged to be pre-packaged in at least one sanitary container. Also, it provides such a single-use disposable cushion system wherein such at least one cushion comprises dimensions of: about 68 inches to about 72 inches long, about 12 inches to about 14 inches wide, and about 1 inch to about 3 inches in thickness. In addition, it provides such a single-use disposable cushion system wherein: such at least one cushion comprises absorbent material; and such absorbent material comprises expanded polyurethane having at least about a 1.4 pound density.

And, it provides such a single-use disposable cushion system wherein: such at least one cushion comprises non-absorbent material; and such non-absorbent material comprises micro cellular closed cell crosslink polyethylene having at least about a 2 pound density.

In accordance with another preferred embodiment hereof, this invention provides a method of cushioning medical transport backboards comprising the steps of: providing at least one sanitary supply of cushions, each such cushion comprising at least one adhesive strip having at least one protective covering, adapted to cushion such medical transport backboards; wherein such cushion comprises at least one cutaway portion adapted to assist folding of such cushion to assist storage in such at least one sanitary cushion supply; before placing a patient, selecting at least one such cushion from such at least one sanitary cushion supply; removing any protection from such adhesive strip on such cushion and arranging such cushion on such medical transport backboard; after treatment of such patient, removing such cushion; and disposing of such at least one cushion.

In accordance with another preferred embodiment hereof, this invention provides each and every novel feature, element, combination, step and/or method disclosed or suggested by this patent application.

DETAILED DESCRIPTION OF THE BEST MODES AND PREFERRED EMBODIMENTS OF THE INVENTION

Figure 1:
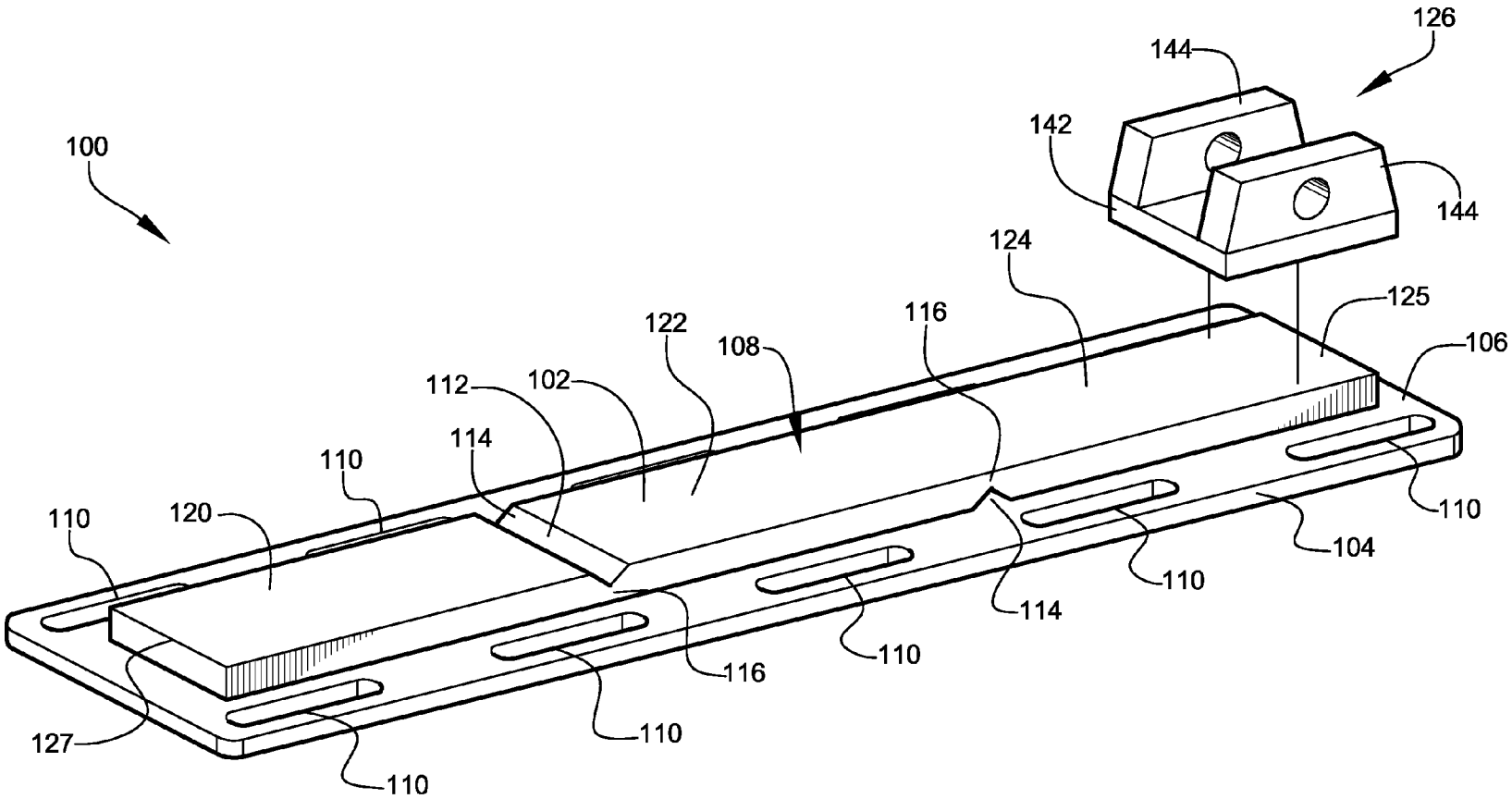
FIG. 1 shows a perspective view illustrating a disposable cushion of the disposable cushion system, adhesively applied to a backboard, according to a preferred embodiment of the present invention.

FIG. 1 shows a perspective view illustrating a disposable cushion 102 of the disposable cushion system 100, adhesively applied to a backboard 104, according to a preferred embodiment of the present invention. FIG. 1 preferably shows the top side 108 of disposable cushion 102. Disposable cushion 102 is preferably placed by medical personnel upon a backboard 104 for use to cushion and support a patient being transported by such backboard 104 (at least embodying herein at least one cushion structured and arranged to cushion the at least one medical backboard). Disposable cushion 102 is preferably placed along a top portion 106 of backboard 104, as shown. Preferably, disposable cushion 102 is placed at least between the handhold portions 110 of backboard 104, preferably to cushion the area where a patient would be placed onto such a backboard 104, as shown (at least embodying herein wherein said at least one cushion is structured and arranged to essentially cover the at least one patient holding surface). Disposable cushion 102 may be sized to slightly encroach on the handhold portions 110; however, the handhold portions 110 preferably are accessible by medical personnel to lift the backboard 104. Upon reading this specification, those with ordinary skill in the art will now appreciate that, under appropriate circumstances, considering such issues as design preference, user preferences, marketing preferences, cost, structural requirements, available materials, technological advances, etc., other cushion arrangements such as, for example, larger or wider cushion dimensions that provide for handhold portion accessibility, etc., may suffice.

Disposable cushion 102 has preferable dimensions of about 68 inches to about 72 inches long, about 12 inches to about 14 inches wide and about 1 inch in thickness. In a preferred embodiment, disposable cushion 102 has preferable dimensions of 72 inches long, 13 inches wide and one inch in thickness, preferably comprised of three equal 24 inch sections. Upon reading this specification, those with ordinary skill in the art will now appreciate that, under appropriate circumstances, considering such issues as design preference, user preferences, marketing preferences, cost, structural requirements, available materials, technological advances, etc., other dimensions such as, for example, those dimensions best fitting the preferred backboard being used, thicker or thinner, wider, shorter or longer, etc., may suffice.

Disposable cushion 102 is preferably made from absorbent material. Alternately preferably, disposable cushion 102 is made from non-permeable material (non-absorbent). In order to differentiate between an absorbent material and a non-permeable material, the absorbent materials are preferably a different color from the non-permeable materials. In a preferred embodiment the absorbent material is preferably gray in color and the non-permeable material is preferably white in color.

The absorbent material is preferably comprised essentially of expanded polyurethane, preferably gray in color, preferably about 1 inch thick. Further, absorbent material is preferably about 1.4 pound density, preferably having an indentation load deflection (ILD) of 0.80. Different densities of absorbent material may be provided in different colors to differentiate between densities. Upon reading this specification, those with ordinary skill in the art will now appreciate that, under appropriate circumstances, considering such issues as design preference, user preferences, marketing preferences, cost, structural requirements, available materials, technological advances, etc., other material arrangements such as, for example, higher density, thicker, different colored, etc., may suffice.

The non-absorbent material preferably comprises essentially of micro cellular closed cell crosslink polyethylene, preferably having at least about a 2 pound density, preferably white in color. Upon reading this specification, those with ordinary skill in the art will now appreciate that, under appropriate circumstances, considering such issues as design preference, user preferences, marketing preferences, cost, structural requirements, available materials, technological advances, etc., other material arrangements such as, for example, higher density, thicker, different colored, etc., may suffice.

Preferably, the absorbent material, once used, is securely placed in a hazardous material storage for disposal. Preferably the non-permeable material may be disposed of or reused as packing material after proper cleaning of any hazardous material or fluids. Upon reading this specification, those with ordinary skill in the art will now appreciate that, under appropriate circumstances, considering such issues as design preference, user preferences, marketing preferences, cost, structural requirements, available materials, technological advances, etc., other cushion arrangements such as, for example, different colors, materials, densities, other uses, combinations of permeable and non-permeable material, etc., may suffice.

In a preferred embodiment of the present invention, both an absorbent and a non-permeable cushion are provided to medical personnel, so that such medical personnel may choose between usage of either an absorbent or a non-permeable cushion. For example, with only an internal injury such as a broken bone it may be preferable to use a non-permeable cushion (such cushion may then be considered for recycling purposes); however, in cases where there are significant fluid releases it may be preferable to use an absorbent cushion (thereby assisting easier clean-up and reducing the chances of cross-contamination to the medical personnel). Upon reading this specification, those with ordinary skill in the art will now appreciate that, under appropriate circumstances, considering such issues as design preference, user preferences, marketing preferences, cost, structural requirements, available materials, technological advances, etc., other cushion selection arrangements such as, for example, cushions that have a permeable side and a non-permeable side, etc., may suffice.

Preferably, disposable cushion 102 comprises folding elements 112 (at least embodying herein wherein said at least one cushion comprises at least one folding element structured and arranged to assist folding said at least one cushion). Preferably, folding elements 112 comprise at least two cut-away portions 114 (at least embodying herein wherein said at least one transverse folding element comprises at least one cut-away portion), preferably V-cut, preferably in about a 45-degree angle, as shown. Preferably, folding elements 112 are placed traverse to the longitudinal length of the disposable cushion 102, preferably providing a living hinge 116, as shown (this arrangement at least embodies herein wherein said at least one folding element comprises at least one transverse folding element to assist folding said at least one cushion longitudinally so as to decrease at least one longitudinal length. Living hinge 116 (at least embodying herein wherein said at least one cut-away portion comprises at least one living hinge) referring to the attributes of the disposable cushion material 128 being flexible enough to allow any two disposable cushion sections hinged together by the combination of cutaway portions 114 and material reduction described (and shown), to be folded over utilizing the remaining cushion material 118 adjacent the cutaway portions 114, as shown. Preferably, use of the folding elements 112 provides for the disposable cushion 102 to be easily folded longitudinally into a compact unit for storage, as well as for a smaller size for disposal, as shown (See FIG. 4).

Preferably, disposable cushion 102 comprises three disposable cushion sections 120, 122, and 124, as shown. Disposable cushion sections 120, 122, and 124 are preferably about equal in length and width, as shown. Upon reading this specification, those with ordinary skill in the art will now appreciate that, under appropriate circumstances, considering such issues as design preference, user preferences, marketing preferences, cost, structural requirements, available materials, technological advances, etc., other dimension arrangements such as, for example, different sized sections, widths, lengths, etc., may suffice.

Preferably, each respective living hinge 116 is placed approximately 23½ inches from the head 125 of disposable cushion 102 and approximately 23½ inches from the foot 127 of disposable cushion 102 so that the disposable cushion 102 may be folded in about equal sections, as shown. Upon reading this specification, those with ordinary skill in the art will now appreciate that, under appropriate circumstances, considering such issues as design preference, user preferences, marketing preferences, cost, structural requirements, available materials, technological advances, etc., other living hinge dimension arrangements such as, for example, more than two living hinges, one living hinge, etc., may suffice.

Preferably, at least one headrest portion 126 may be added to the disposable cushion 102, as shown. Headrest portion 126 is preferably provided along with disposable cushion 102 in a kit form. Headrest portion 126, may also be preferably selected from existing backboard-assisting headrests available in the marketplace that are able to be attached adhesively, or otherwise, to disposable cushion 102, as shown. In addition, headrest portion 126 may also be used as part of a head restraint system used by emergency personnel and therefore, is highly preferred to be selected by future purchasers of the disposable cushion system 100 for specific use, as needed, during head restraint operations. In a preferred embodiment, the headrest portion 126 preferably comprises at least one head rest cushion 142, preferably about 1-inch in thickness and preferably made from the same disposable cushion material 128 as used in the disposable cushion 102. For example, preferably each side block 144 comprises about 2 inches of thickness, also preferably made from the same disposable cushion material 128 as used in the disposable cushion 102. Upon reading this specification, those with ordinary skill in the art will now appreciate that, under appropriate circumstances, considering such issues as design preference, user preferences, marketing preferences, cost, structural requirements, available materials, technological advances, etc., other headrest arrangements such as, for example, different cushion materials, different dimensions, etc., may suffice.

Figure 2:
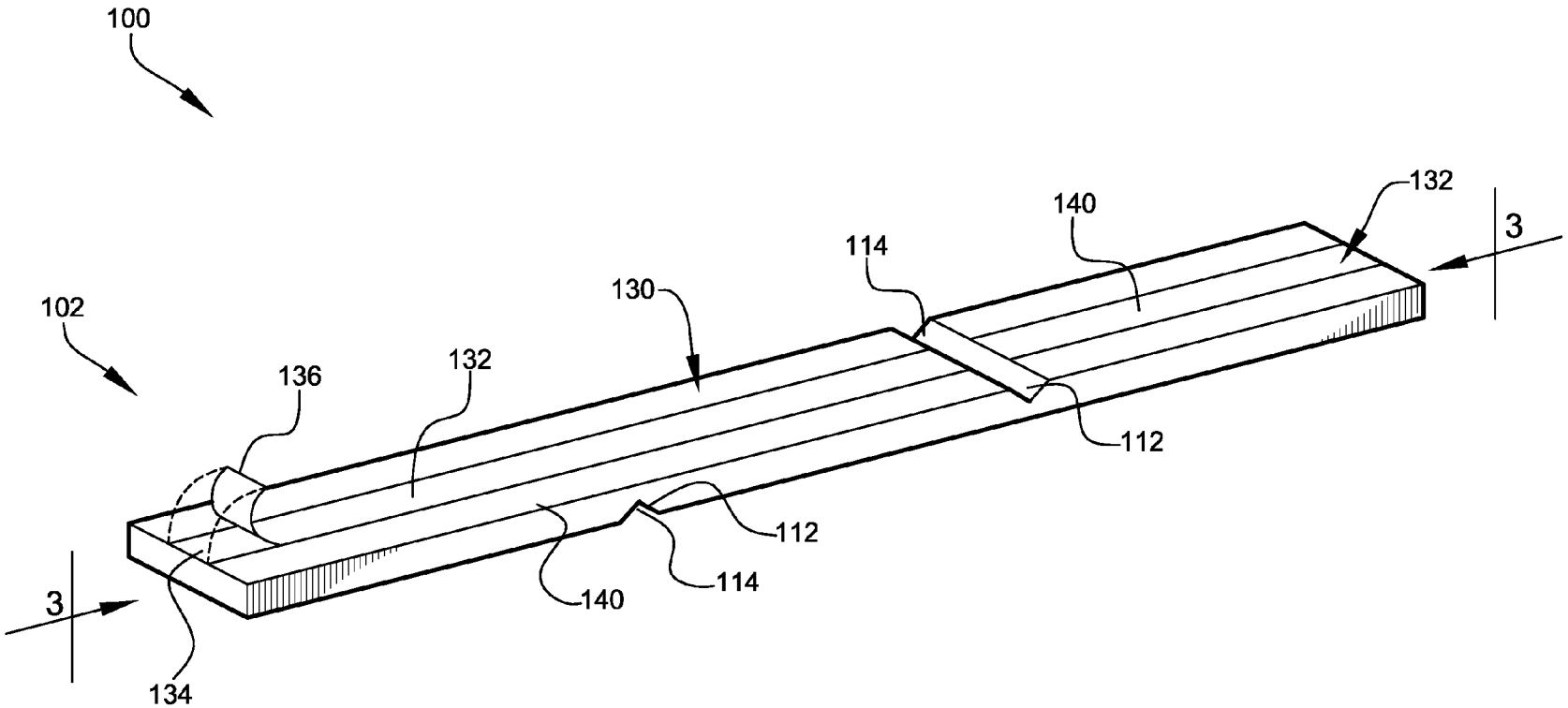
FIG. 2 shows a perspective view, illustrating the disposable cushion of the disposable cushion system, according to the preferred embodiment of FIG. 1.
Figure 3:
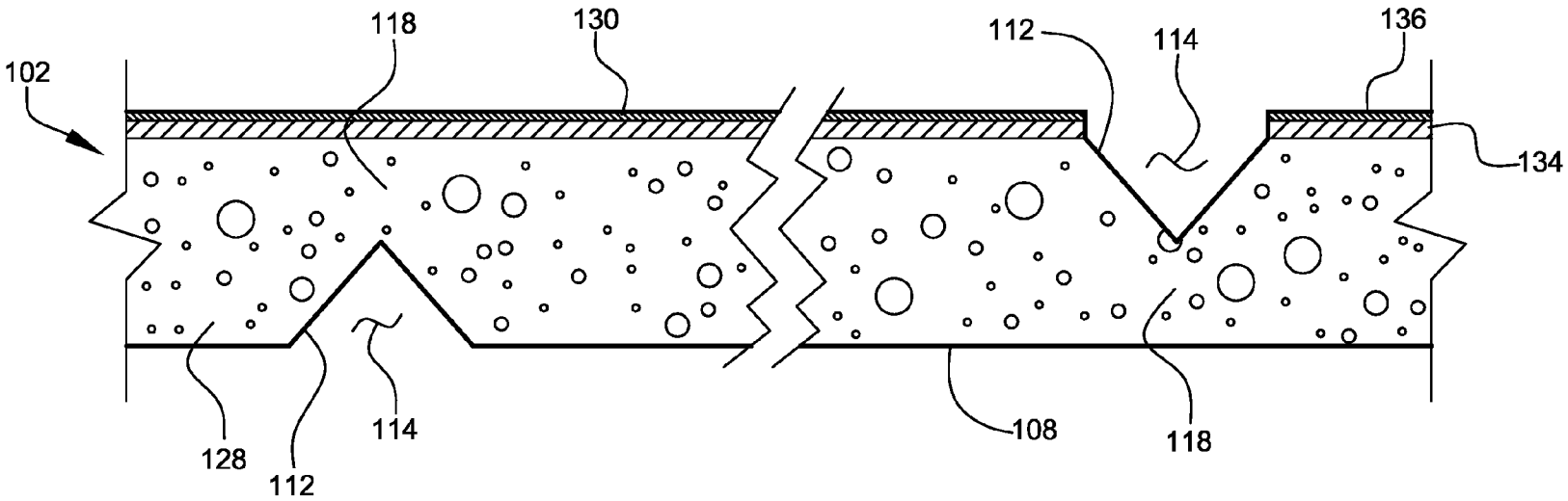
FIG. 3 shows a partial sectional view through section 3-3 of FIG. 2.

FIG. 2 shows a perspective view, illustrating the bottom side 130 of disposable cushion 102, according to the preferred embodiment of FIG. 1. FIG. 3 shows a partial sectional view through section 3-3 of FIG. 2.

The bottom side 130 of disposable cushion 102 is shown in FIG. 2 and further illustrates the cutaway portions 114 and living hinge 116 discussed above in relation to the disposable cushion 102, as shown. Bottom side 130 preferably comprises at least one attaching element to attach the cushion 102 to the backboard 104, preferably an adhesive portion 132, preferably comprising at least one adhesive 134, and at least one removable protective covering 136, as shown. In the illustrated preferred embodiment, adhesive portion 132 (at least embodying herein wherein said at least one cushion comprises at least one attacher structured and arranged to assist removable attachment of said at least one cushion to the at least one medical backboard) is preferably located along the center line of disposable cushion 102, preferably about 4 inches in width, as shown. Upon reading this specification, those with ordinary skill in the art will now appreciate that, under appropriate circumstances, considering such issues as design preference, user preferences, marketing preferences, cost, structural requirements, available materials, technological advances, etc., other adhesive portion arrangements such as, for example, located on both ends, located on both sides, intermittent located adhesive, etc., may suffice.

Preferably, adhesive portion 132 is continuous along the flat bottom portion 140 and, in use, is preferably adhesively attached to the disposable cushion 102, as shown in FIG. 1. It is not preferable to place adhesive portion 132 in the cutaway portion 114.

Figure 4:
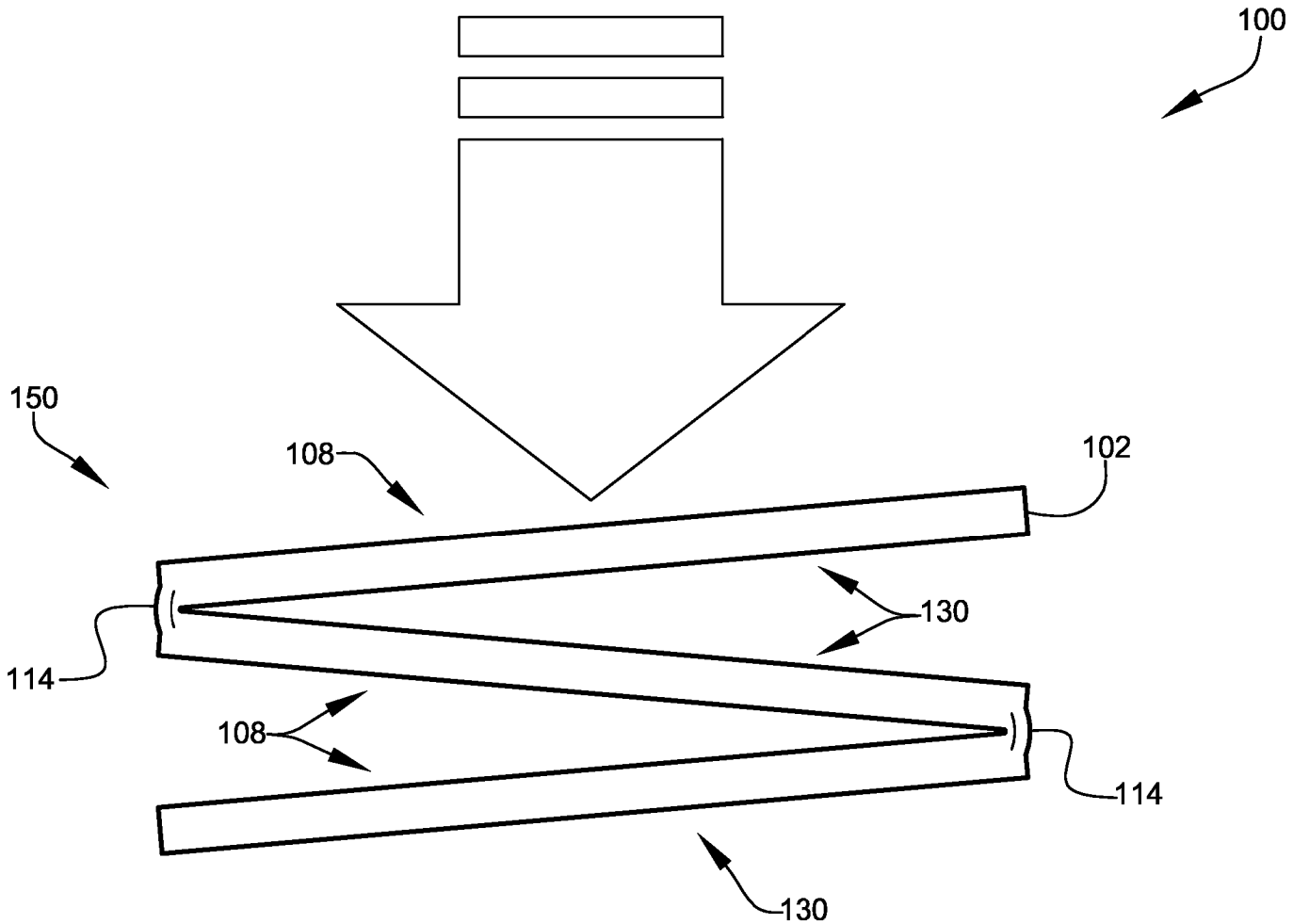
FIG. 4 shows a front elevation view of the disposable cushion in a folded position according to the preferred embodiment of FIG. 1.
Figure 5:
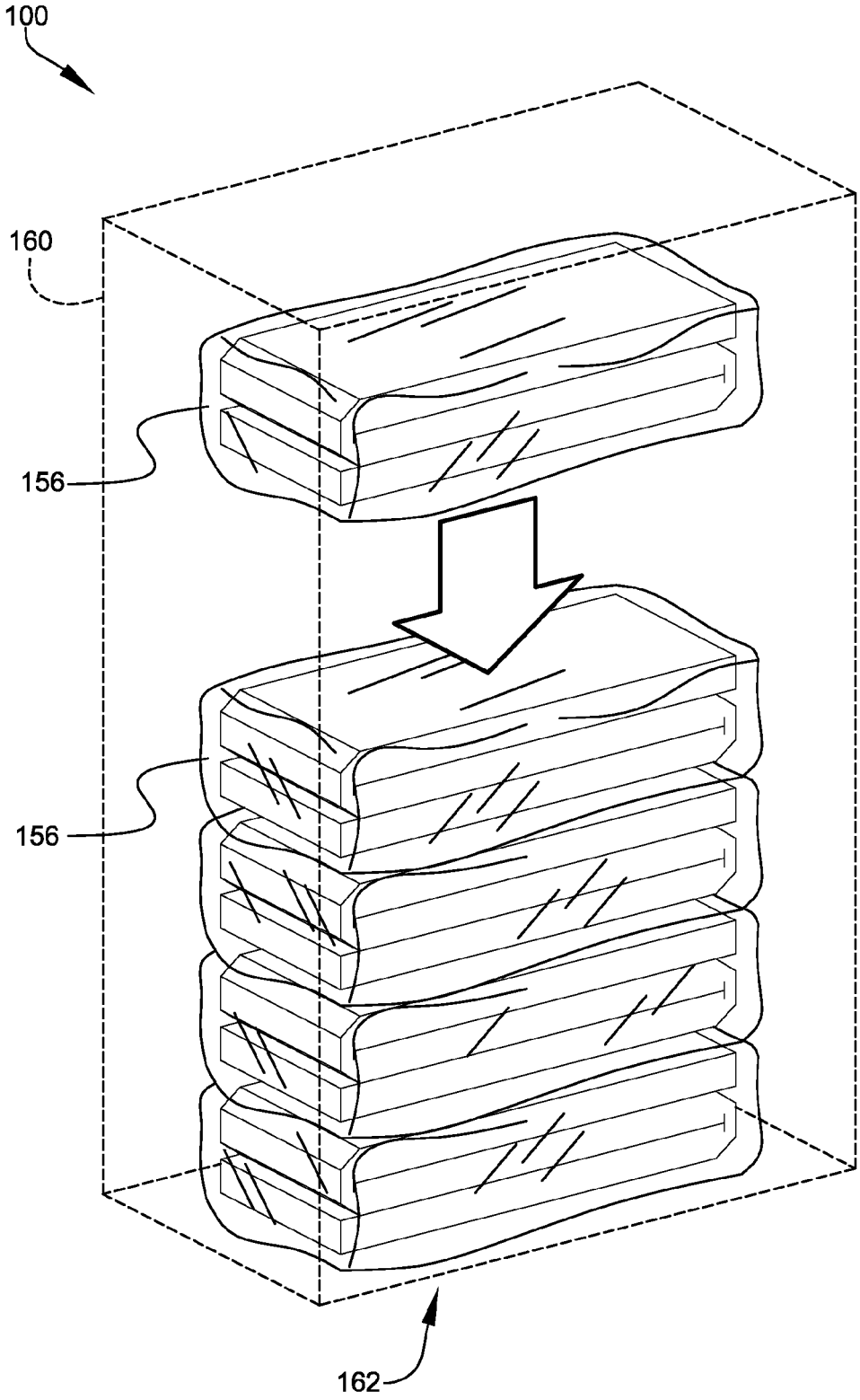
FIG. 5 shows a perspective view, of a preferred packaging and stacking arrangement of the disposable cushion system, according to a preferred embodiment of the present invention.

FIG. 4 shows a front elevation view of the disposable cushion in a folded position 150 according to the preferred embodiment of FIG. 1. FIG. 5 shows a perspective view of a preferred packaging and stacking arrangement of the disposable cushion system 100 according to a preferred embodiment of the present invention.

Disposable cushion 102 is preferably placed and stored in a folded position 150, as shown. Emergency vehicles, hospitals, pools, and other places that commonly use backboards typically have limited space for storage of emergency-related supplies. As such, it is highly preferred that disposable cushion 102 be compressed and compacted in a relatively small package 156 for use, as needed, by such emergency personnel as may be utilizing a backboard 104 and preferably disposable cushion 102.

Preferably, when disposable cushion 102 is packaged in package 156, such package 156 is easily stored within the confines of typical shelf space 160 available at such locations utilizing at least one such backboard 104, as shown. Upon reading this specification, those with ordinary skill in the art will now appreciate that, under appropriate circumstances, considering such issues as design preference, user preferences, marketing preferences, cost, structural requirements, available materials, technological advances, etc., other backboards such as, for example, other makes, models and sizes not illustrated, etc., may suffice.

In use, at least one sanitary cushion supply 162 (at least embodying herein wherein said at least one cushion is structured and arranged to be pre-packaged in at least one sanitary container) of disposable cushions 102 are provided as stated above, preferably pre-packaged in removable protective covering 136 preferably at least a clear plastic wrap, to a user (medical personal, stocking area, etc.). Preferably, before placing a patient, a user selects at least one such disposable cushion 102 from at least one sanitary cushion supply 162, removes the protective strip from the adhesive strip on disposable cushion 102 and arranges disposable cushion 102 on such medical transport backboard 104.

Preferably, after treatment of such patient, the disposable cushion 102 is removed from backboard 104 and disposed of, preferably in accordance with the proper laws and regulations. This arrangement at least embodies herein a method of cushioning medical transport backboards comprising the steps of: providing at least one sanitary supply of cushions, each such cushion comprising at least one adhesive strip having at least one protective covering, adapted to cushion such medical transport backboards; wherein such cushion comprises at least one cutaway portion adapted to assist folding of such cushion to assist storage in such at least one sanitary cushion supply; before placing a patient, selecting at least one such cushion from such at least one sanitary cushion supply; removing any protection from such adhesive strip on such cushion and arranging such cushion on such medical transport backboard; after treatment of such patient, removing such cushion; and disposing of such at least one cushion.

Although applicant has described applicant's preferred embodiments of this invention, it will be understood that the broadest scope of this invention includes modifications such as diverse shapes, sizes, and materials. Such scope is limited only by the below claims as read in connection with the above specification. Further, many other advantages of applicant's invention will be apparent to those skilled in the art from the above descriptions and the below claims.

What is claimed is:

1. A single-use disposable cushion system, relating to cushioning at least one medical backboard having at least one patient holding surface, comprising:

a) at least one cushion structured and arranged to cushion the at least one medical backboard;

b) wherein said at least one cushion is structured and arranged to essentially cover the at least one patient holding surface;

c) wherein said at least one cushion comprises at least one folding element structured and arranged to assist folding said at least one cushion;

d) wherein said at least one folding element comprises at least one transverse folding element to assist folding said at least one cushion longitudinally so as to decrease at least one longitudinal length;

e) wherein said at least one transverse folding element comprises at least one cut-away portion;

f) wherein said at least one cushion comprises at least one attacher structured and arranged to assist removable attachment of said at least one cushion to the at least one medical backboard; and g) wherein said at least one attacher is structured and arranged to substantially extend the length of said at least one cushion, along such at least one longitudinal length, excluding said at least one cut-away portion.

2. The single-use disposable cushion system according to claim 1 wherein said at least one cut-away portion comprises at least one living hinge.

3. The single-use disposable cushion system according to claim 1 wherein said at least one cushion is structured and arranged to be pre-packaged in at least one sanitary container.

4. The single-use disposable cushion system according to claim 1 wherein said at least one cushion comprises dimensions of:

a) about 68 inches to about 72 inches long, b) about 12 inches to about 14 inches wide, and c) about 1 inch to about 3 inches in thickness.

5. The single-use disposable cushion system according to claim 1 wherein said at least one cushion comprises absorbent material.

6. The single-use disposable cushion system according to claim 5 wherein said absorbent material comprises essentially expanded polyurethane having at least about a 1.4 pound density.

7. The single-use disposable cushion system according to claim 1 wherein said at least one cushion comprises non-absorbent material.

8. The single-use disposable cushion system according to claim 7 wherein said non-absorbent material comprises essentially micro cellular closed cell crosslink polyethylene having at least about a 2 pound density.

9. The single-use disposable cushion system according to claim 2 wherein said at least one living hinge element comprises at least one V-cut groove in said at least one cushion.

10. The single-use disposable cushion system according to claim 1 wherein said at least one cushion comprises exactly two cut-away portions.

11. The single-use disposable cushion system according to claim 1 wherein said at least one transverse folding element comprises exactly two living hinge elements.

12. The single-use disposable cushion system according to claim 1 wherein said at least one attacher comprises adhesive.

13. The single-use disposable cushion system according to claim 12 wherein said at least one adhesive comprises releasable adhesive.

14. The single-use disposable cushion system according to claim 1 further comprising at least one headrest.

15. The single-use disposable cushion system according to claim 14 wherein said at least one headrest is removably attachable to said at least one cushion.

16. The single-use disposable cushion system according to claim 15 wherein said at least one headrest comprises essentially the same material as said at least one cushion.

17. The single-use disposable cushion system according to claim 1 further comprising at least one medical backboard.

18. A single-use disposable cushion system, relating to cushioning at least one medical backboard having at least one patient holding surface, comprising:

a) at least one cushion structured and arranged to cushion the at least one medical backboard;

b) wherein said at least one cushion is structured and arranged to essentially cover the at least one patient holding surface;

c) wherein said at least one cushion comprises at least one folding element structured and arranged to assist folding said at least one cushion;

d) wherein said at least one folding element comprises at least one transverse folding element to assist folding said at least one cushion longitudinally so as to decrease at least one longitudinal length;

e) wherein said at least one transverse folding element comprises at least one cut-away portion;

f) wherein said at least one cut-away portion comprises at least two living hinges;

g) wherein said at least one cushion comprises at least one attacher structured and arranged to assist removable attachment of said at least one cushion to the at least one medical backboard;

h) wherein said at least one cushion is structured and arranged to be pre-packaged in at least one sanitary container; and i) wherein said at least one attacher is structured and arranged to substantially extend the length of said at least one cushion, along such at least one longitudinal length, excluding said at least one cut-away portion.

19. The single-use disposable cushion system according to claim 18 wherein said at least one cushion comprises dimensions of:

a) about 68 inches to about 72 inches long, b) about 12 inches to about 14 inches wide, and c) about 1 inch to about 3 inches in thickness.

20. The single-use disposable cushion system according to claim 19 wherein:

a) said at least one cushion comprises absorbent material; and b) said absorbent material comprises expanded polyurethane having at least about a 1.4 pound density.

21. The single-use disposable cushion system according to claim 19 wherein:

a) said at least one cushion comprises non-absorbent material; and b) said non-absorbent material comprises micro cellular closed cell crosslink polyethylene having at least about a 2 pound density.

* * * * *